US009103169B2

(12) United States Patent
Shen et al.

(10) Patent No.: US 9,103,169 B2
(45) Date of Patent: Aug. 11, 2015

(54) FIXED CUTTER BIT PARTIAL BLADE CONNECTION AT BIT CENTER

(75) Inventors: Yuelin Shen, Houston, TX (US); Youhe Zhang, Tomball, TX (US); Paul Higgins, Houston, TX (US)

(73) Assignee: Smith International, Inc., Houston, TX (US)

( * ) Notice: Subject to any disclaimer, the term of this patent is extended or adjusted under 35 U.S.C. 154(b) by 596 days.

(21) Appl. No.: 12/126,666

(22) Filed: May 23, 2008

(65) Prior Publication Data

US 2008/0289881 A1 Nov. 27, 2008

Related U.S. Application Data

(60) Provisional application No. 60/939,693, filed on May 23, 2007.

(51) Int. Cl.
*E21B 10/00* (2006.01)
*E21B 10/42* (2006.01)

(52) U.S. Cl.
CPC ..... *E21B 10/42* (2013.01)

(58) Field of Classification Search
USPC ..... 175/327, 421; 76/108.2, 108.4
See application file for complete search history.

(56) References Cited

U.S. PATENT DOCUMENTS

| | | | | |
|---|---|---|---|---|
| 5,651,421 | A | 7/1997 | Newton et al. | |
| 7,100,714 | B1 | 9/2006 | Sollami | |
| 2007/0221406 | A1 * | 9/2007 | Hall et al. | 175/40 |

OTHER PUBLICATIONS

Combined Search and Examination Report issued in British Application No. GB0809438.5; Dated Jul. 10, 2008 (3 pages).

* cited by examiner

*Primary Examiner* — Sean Andrish

(57) ABSTRACT

A fixed cutter drill bit including a bit body having a plurality of primary blades extending radially from a bit center area, wherein the bit center area includes a partial connection between at least two of the plurality of primary blades. The fixed cutter drill bit further including at least one cutter disposed on at least one of the blades. Additionally, a method of designing a fixed cutter drill bit includes modeling the fixed cutter drill bit, the fixed cutter drill bit including a plurality of primary blades extending radially from a bit center area, wherein the plurality of primary blades includes a plurality of cutters. The method further including determining a center of an innermost cutter on each primary blade, creating a partial connection between the primary blades, and outputting the model of the fixed cutter drill bit.

23 Claims, 10 Drawing Sheets

FIXED CUTTER BIT PARTIAL BLADE CONNECTION AT BIT CENTER

CROSS-REFERENCE TO RELATED APPLICATIONS

This applications claims the benefit, pursuant to 35 U.S.C. 119(e), of U.S. Provisional Patent Application No. 60/939,693, filed May 23, 2007. That application is expressly incorporated by reference in its entirety.

BACKGROUND

1. Field of the Disclosure

Embodiments disclosed herein relate generally to fixed cutter drill bits having a partial connection of the blades at the bit center area. More specifically, embodiments disclosed herein relate to fixed cutter drill bits having a partial connection that partially connects primary blades of the fixed cutter drill bit.

2. Background Art

Fixed cutter bits, such as PDC drill bits, are commonly used in the oil and gas industry to drill well bores. One example of a conventional drilling system for drilling boreholes in subsurface earth formations is shown in FIG. 1. This drilling system includes a drilling rig 10 used to turn a drill string 12 which extends downward into a well bore 14. Connected to the end of the drill string 12 is a fixed cutter drill bit 20.

As shown in FIG. 2, a fixed cutter drill bit 20 typically includes a bit body 22 having an externally threaded connection at one end 24, and a plurality of blades 26 extending from the other end of bit body 22 and forming the cutting surface of the bit 20. A plurality of cutters 28 are attached to each of the blades 26 and extend from the blades to cut through earth formations when the bit 20 is rotated during drilling. The cutters 28 deform the earth formation by scraping and shearing. The cutters 28 may be, for example, polycrystalline diamond compacts, or any other cutting elements of materials hard and strong enough to deform or cut through the formation. Hardfacing (not shown) may also be applied to the cutters 28 and other portions of the bit 20 to reduce wear on the bit 20 and to increase the life of the bit 20 as the bit 20 cuts through earth formations.

Fixed cutter bits used to drill oil and gas well bores are traditionally manufactured to include a plurality of blades 26 formed on the surface of the drill bit 20. Typically, the blades 26 have been manufactured to extend from an outer gage 27 to a center 29 of the bit 20. However, the center 29 of the bit 30 is generally left open such that each blade 26 forms an independent portion of the bit 20. Fixed cutter bits 20 with blades 26 that are disconnected are generally referred to in the art as separated blade fixed cutter bits.

Referring to FIG. 3, a cross-sectional view of a separated blade fixed cutter bit 30 is shown. Separated blade fixed cutter bit 30 is illustrated having two primary blades 31, with a plurality of cutters 32 disposed on each of primary blades 31. Primary blades 31 have a blade height 33 defined as the top of the structure of the blade and a blade base 34 defining the intersection of each primary blade 31 with the structural base of the bit. As such, primary blades 31 may be defined as the protruding area between blade base 34 and blade height 33. Primary blades 31 extend from an outer gage 37 to a bit center area 38 (illustrated here as an axis extending through the geometric center of the bit). However, as illustrated, primary blades 31 do not connect at bit center area 38. Rather, primary blades 31 remain separated and an open area 39, defined as the area between primary blades 31, is formed.

During drilling, it was found that that center of separated blade fixed cutter bits were structurally weak and prone to cracking after repair. Separated blade fixed cutter bits would often form cracks that run across the bit center area between the nozzles, thereby causing the bits to be unrepairable.

To overcome the problems associated with separated blade fixed cutter bits, fixed cutter drill bit designs were changed such that major blades were connected at the bit center area. Because the blades were connected, and the amount of matrix or steel at the bit center area was thereby increased, it was believed that the structural integrity of the bits would be increased.

Referring to FIG. 4, a cross-section view of a fully connected fixed cutter bit 40 is shown. Fully connected fixed cutter bit 40 is illustrated having two primary blades 41, with a plurality of cutters 42 disposed on each of primary blades 41. Like the separated blade fixed cutter bit 30 (FIG. 3) discussed above, primary blades 41 of fully connected fixed cutter bit 40 have a blade height 43 defined as the top of the structure of the blade and a blade base 44 defining the intersection of each primary blade 41 with the structural base of the bit. Primary blades 41 extend from an outer gage 47 to a bit center area 48. However, unlike separated blade fixed cutter bit 30 (FIG. 3), primary blades 41 are connected at the bit center area 48. As such, blade height 43 extends between primary blades 41, thereby forming a continuous structural element.

When used in drilling, the fully connected primary blades 41 did in fact stop some of the cracking, typically stopping cracks from running across bit center area 48 and between nozzle bores (not shown). However, fully connected primary blades 41 did not stop cracks from forming. Instead of forming across bit center area 48, the cracks shifted to forming behind first, second, and third cutters 49A, 49B, and 49C. Finite element analysis revealed that the fully connected bit designs resulted in thermal residual stress. Furthermore, it was determined that behind first, second, and third cutters 49A, 49B, and 49C, thermal stress (i.e., stress from thermal shock during brazing) and mechanical stress (i.e., stress from drilling), combined to produce cracks that formed more often, earlier, and with less options available for repair.

Accordingly, there exists a continuing need for a fixed cutter bit design that may provide increased structural integrity and resist cracking during drilling.

SUMMARY OF THE DISCLOSURE

In one aspect, embodiments disclosed herein include fixed cutter drill bit including a bit body having a plurality of primary blades extending radially from a bit center area, wherein the bit center area includes a partial connection between at least two of the plurality of primary blades. The fixed cutter drill bit further including at least one cutter disposed on at least one of the blades.

In another aspect, embodiments disclosed herein include a method of designing a fixed cutter drill bit including modeling the fixed cutter drill bit, the fixed cutter drill bit including a plurality of primary blades extending radially from a bit center area, wherein the plurality of primary blades includes a plurality of cutters. The method further including determining a center of an innermost cutter on each primary blade, creating a partial connection between the primary blades, and outputting the model of the fixed cutter drill bit.

In another aspect, embodiments disclosed herein include a method of increasing fixed cutter drill bit integrity including, modeling the fixed cutter drill bit, the fixed cutter drill bit including a plurality of primary blades extending radially from a bit center area, wherein the plurality of primary blades includes a plurality of cutters. The method further including finding a center of an innermost cutter on each primary blade and defining a partial connection. The defining a partial connection including determining a partial connection height, wherein the partial connection height is less than a blade height of each primary blades and determining a transition geometry. The method also including forming a fixed cutter drill bit having the partial connection.

Other aspects and advantages of the disclosure will be apparent from the following description and the appended claims.

DETAILED DESCRIPTION

Generally, embodiments disclosed herein relate to fixed cutter dill bits having a partial connection of the blades at the bit center area. More specifically, embodiments disclosed herein relate to fixed cutter drill bits having a partial connection that partially connects primary blades of the fixed cutter drill bit.

Figure 1:
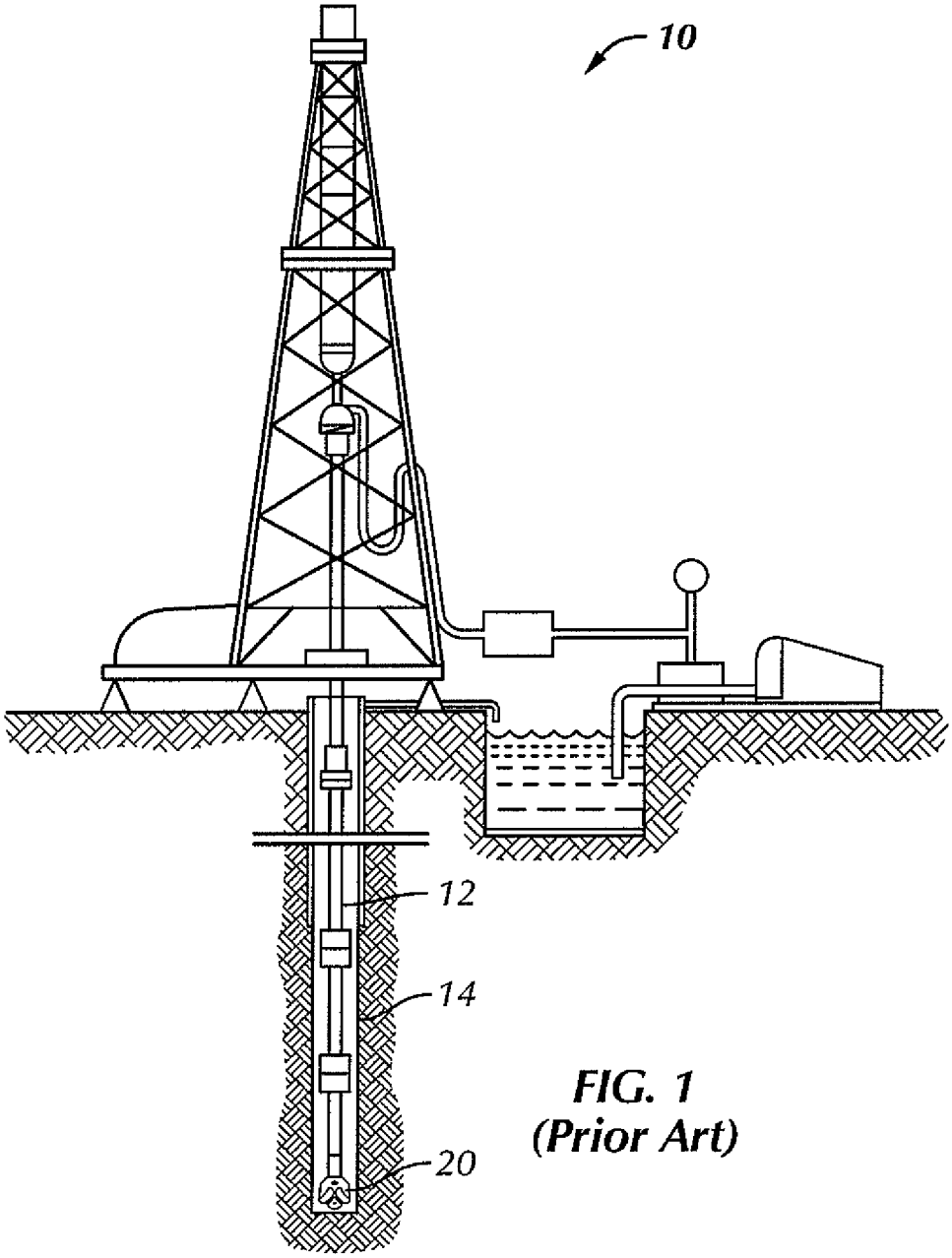
FIG. 1 (Prior Art)
FIG. 1 shows a conventional drilling system for drilling boreholes in subsurface earth formations.
Figure 2:
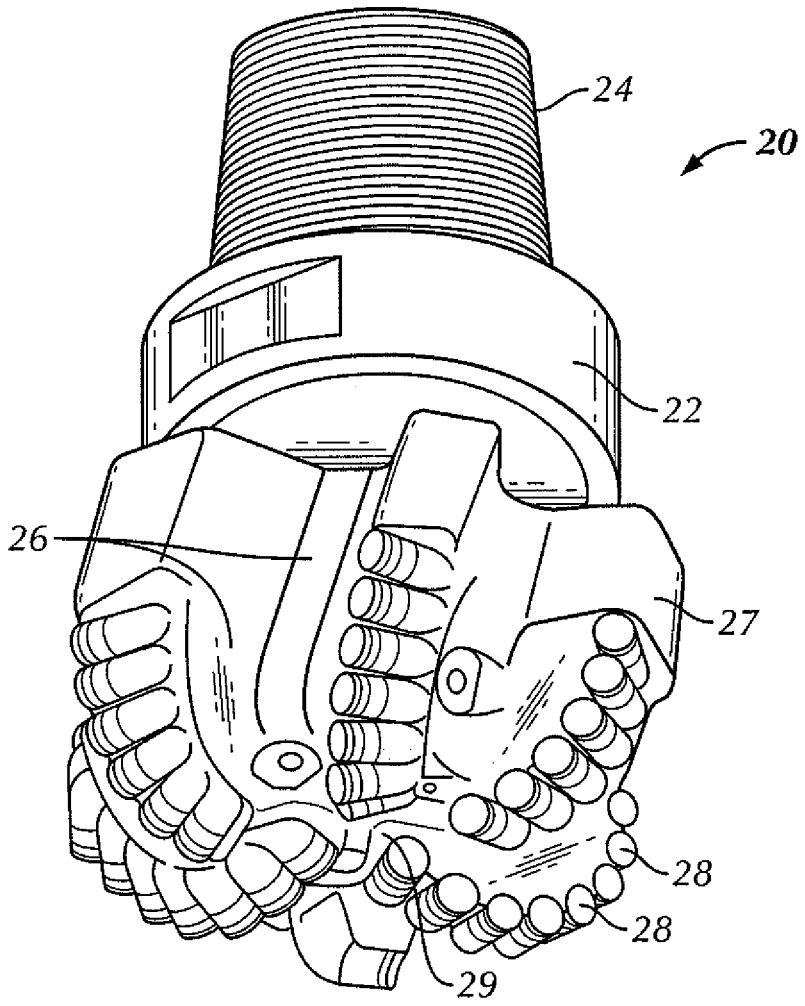
FIG. 2 (Prior Art)
FIG. 2 shows a perspective view of fixed cutter drill bit.
Figure 3:
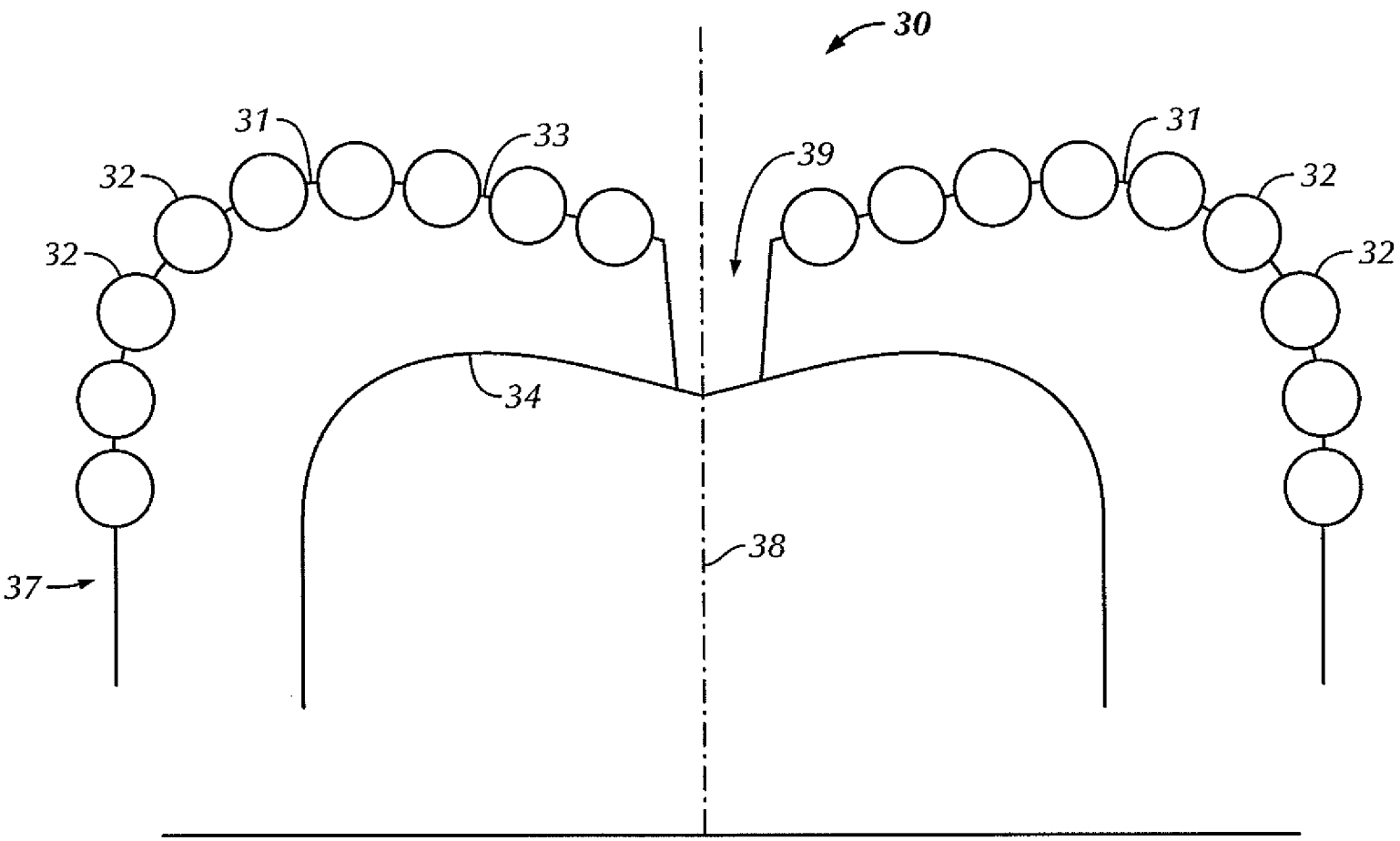
FIG. 3 (Prior Art)
FIG. 3 shows a cross-sectional view of a separated blade fixed cutter bit.
Figure 4:
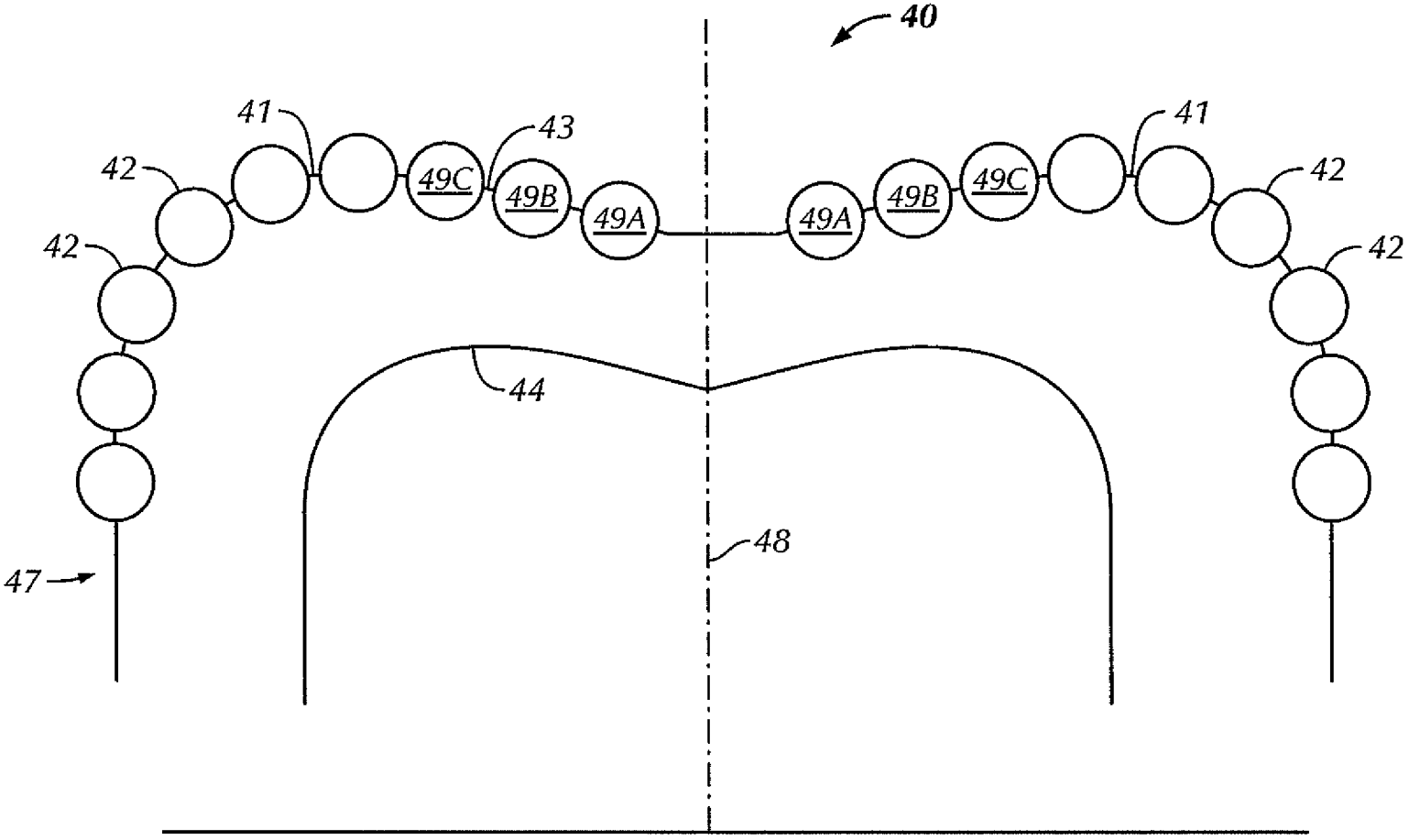
FIG. 4 (Prior Art)
FIG. 4 shows a cross-sectional view of a fully connected blade fixed cutter bit.
Figure 5:
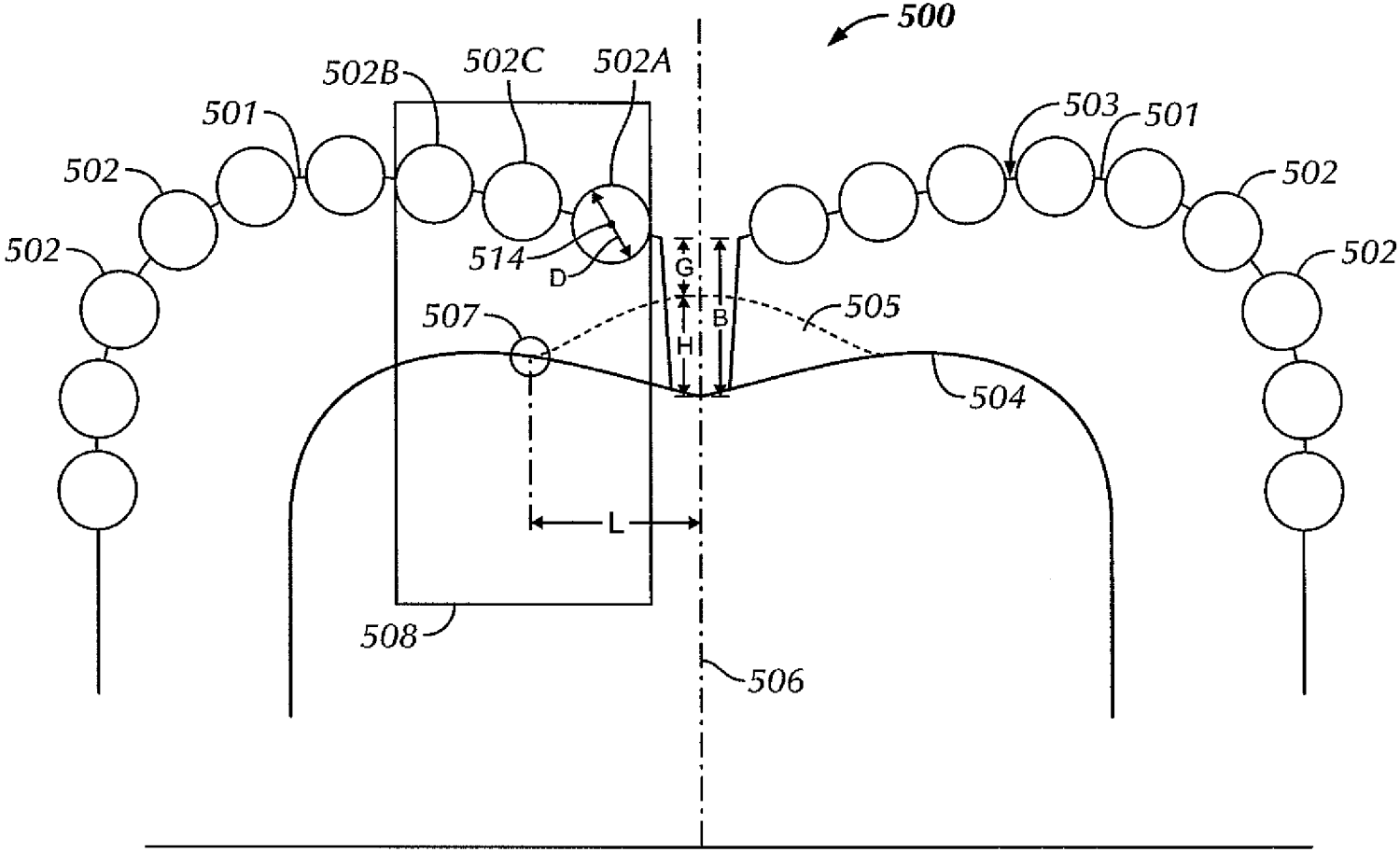
FIG. 5 shows a cross-sectional view of a fixed cutter drill bit according to embodiments of the present disclosure.

Referring to FIG. 5, a cross-sectional view of a fixed cutter drill bit 500 according to embodiments of the present disclosure is shown. In this embodiment fixed cutter drill bit 500 is illustrated as having two primary blades 501 with a plurality of cutters 502 disposed on each of primary blades 501. Primary blades 501 of fixed cutter bit 500 have a blade height 503 defined as the top of the structure of the primary blades 501 and a base portion 504 defining the intersection of each primary blade 501 with the structural base of the bit. While the embodiment illustrated in FIG. 5 has two primary blades 501, those of ordinary skill in the art will appreciate that alternate embodiments may have more than two primary blades and/or a number of primary and secondary blades. Furthermore, those of ordinary skill in the art will appreciate that the number, relative location, and geometry of cutters 502 is germane to fixed cutter drill bits in general, and as such, is not a limitation of the present disclosure.

Fixed cutter bit 500 also includes a partial connection 505 formed between and/or inclusive of primary blades 501. As illustrated, partial connection 505 is a substantially continuous curved region extending from base portion 504 to a height between base portion 504 and blade height 503 extending radially to a transition 507. Furthermore, partial connection 505 is traversed by a bit axis 506 extending though a bit center area. The bit center area (not independently illustrated) is defined as area of intersection of primary blades 501. Those of ordinary skill in the art will appreciate that bit axis 506 defines the rotable center of the bit, and as illustrated, partial connection 505 is intersected by bit axis 506. However, in alternate embodiments, primary blades 501 may not be of similar or same geometry, and as such, the bit center area may not be traversed by bit axis 506. In such an embodiment, partial connection 505 still occurs at the bit center area, but may not be intersected by bit axis 506. Thus, those of ordinary skill in the art will appreciate that partial connection 505 is defined as a portion of bit 500 extending between primary blades 501 at the bit center area.

In one embodiment, partial connection 505 is formed as a partial connection between primary blades 501. The geometry of partial connection 505 may be of any geometry that provides for increased structural integrity to the bit, thereby reducing the risk of cracking behind cutters or between nozzles, as described above. In one aspect, the geometry of partial connection 505 is defined in terms of a "length" and a "height."

The length L of partial connection 505 refers to the distance partial connection 505 extends radially from the bit center. Preferably, the length L of partial connection 505 may vary between a radially inner portion of a first cutter (i.e., a portion of a cutter disposed on the blade proximate the bit center) 502A and a radially outer portion of a third cutter (i.e., a portion of a cutter disposed on the blade proximate the bit gage) 502B. Such embodiments are illustrated in FIG. 5 by the shaded region 508, which defines the range of lengths L to which transition 507 of partial connection 505 may preferably extend. Those of ordinary skill in the art will appreciate that while FIG. 5 is illustrated as including a substantially symmetrical partial connection 505, in other embodiments, partial connection 505 may extend to different lengths L relative to different primary blades 501. Thus, in one embodiment, partial connection 505 may extend to a center point of a second cutter on a first primary blade, while the partial connection 505 may extend to a center point of a third cutter on a second primary blade. In still other embodiments, the length L of partial connection 505 may be adjusted to extend between more than two primary blades 501.

Those of ordinary skill in the art will appreciate that partial connection 505 includes a raised area at the bit center area of fixed cutter bit 500 between at least two of the plurality of primary blades 501. Partial connection 505 is defined in terms of partial connection length L and height H, and the raised area extends to a transition 507, as described above. As illustrated, partial connection 505 includes the raised area between two or three primary blades 501, however, in alternate embodiments, partial connection 505 may include a raised area between four, five, or any number of additional primary blades 501. Furthermore, partial connection 505 may include raised areas between primary blade 501, secondary blades (not illustrated), or other bit features, such as, for example, nozzles.

Figure 6:
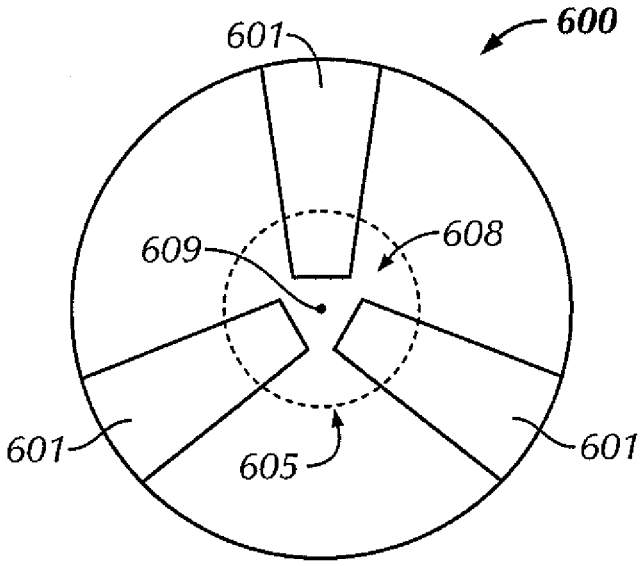
FIG. 6 shows a top view of a fixed cutter drill bit according to embodiments of the present disclosure.

Referring briefly to FIG. 6, a top view of a fixed cutter bit 600 according to an embodiment of the present disclosure is shown. In this embodiment, three primary blades 601 extend radially from a bit center area 608. However, each of primary blades 601 are oriented around, but a different radial distance from, a geometric bit center 609. In this embodiment, an area of a partial connection 605, is defined by the dashed line. Partial connection 605, as illustrated, forms a substantially circular region extending outward a fixed radius from the geometric bit center 609. However, those of ordinary skill in the art will appreciate that in other embodiments, partial connection 605 may form an irregular shape.

Figure 7:
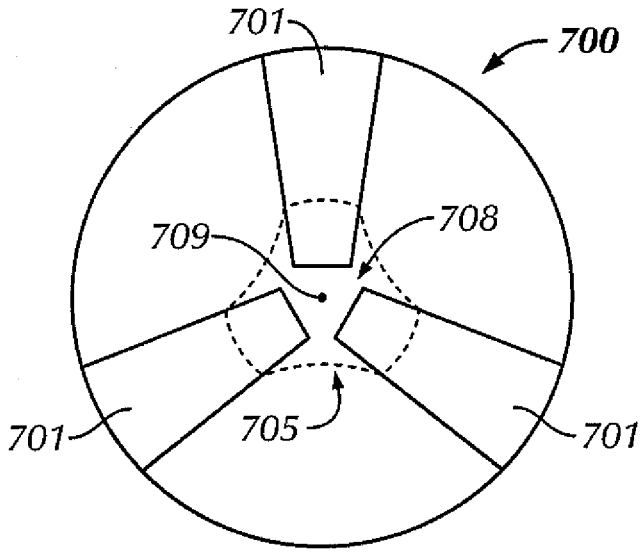
FIG. 7 shows a top view of a fixed cutter drill bit having an irregular partial connection accord to embodiments of the present disclosure.

Referring to FIG. 7, a top view of a fixed cutter bit 700 according to an embodiment of the present disclosure is shown. In this embodiment, three primary blades 701 extend from a bit center area 708. However, each of primary blades 701 are oriented around, but a different radial distance from, a geometric bit center 709. Unlike the substantially circular region formed by the partial connection 605 (FIG. 6), a partial connection 705 includes a relatively irregular shape. Rather than defining partial connection 705 as being a fixed radius from geometric bit center 709, the radial extension of partial connection 705 is based on bit design parameters. Examples of such parameters may include, for example, a blade geometry, a blade number, a bit material type, a cutter type, a cutter location, a cutter geometry, a nozzle location, a nozzle size, a desired hydraulic pattern, a desired dull grade, or other design parameters known to those of ordinary skill in the art.

Referring back to FIG. 5, in addition to defining partial connection 505 in terms of length L, the height H of partial connection 505 may also be defined. Partial connection height H is the maximum height throughout the extension of partial connection 505. In the illustrated embodiment, partial connection height H is measured at the center of partial connection 505 and is defined as the difference between a blade height B and a gap G. Those of ordinary skill in the art will appreciate that in certain embodiments it may be desirable that gap G is greater than a diameter D of the innermost cutter 502A. Those skilled in the art will further appreciate that for any partial connection 505, a partial connection ratio G/B may be expressed as a ratio of gap G to blade height B.

When designing fixed cutter drill bits having partially connected primary blades, partial connection ratio G/B may be used to determine a desired partial connection height H for a particular drill bit. Those of ordinary skill in the art will appreciate that varying the partial connection height for a given bit may result in beneficial bit properties. For example, it may be desirable to decrease the likelihood of cracking at the bit center area or between nozzles. In such a design, it may be preferable to have a thicker partial connection height H, and thus the bit designer may choose a smaller partial connection ratio. In other embodiments, it may be beneficial to decrease the stresses behind cutters 502. In such an embodiment, the bit designer may choose a larger partial connection ratio to decrease such stresses. Those of ordinary skill in the art will appreciate that partial connection ratio G/B will be determined based on the considerations of a given bit for a specified formation, and as such, may take into consideration other bit design parameters or other features of a given bit or drilling operation.

In certain embodiments, those of ordinary skill in the art will appreciate that it may be preferable to design partial connection 505 such that partial connection height H is greater than gap G. Such embodiments may provide the greatest increase in structural integrity by increasing the amount of matrix material or steel over the center of the bit, while maintaining relatively low levels of stress behind first, second, and third cutters 502A, 502C, and 502B. However, in other embodiments, a preferable partial connection ratio G/B may range from greater than 0 to less than 10. For example, in certain embodiments, preferable partial connection ratio G/B may range from 0.1 to 0.9, 0.25 and 0.75, or 0.33 to 0.66. Moreover, in certain bit designs, those of ordinary skill in the art will appreciate that a partial connection ratio G/B of about 0.5 may provide the greatest benefit to structural integrity. While the above partial connection ratios G/B may provide increased bit integrity, those of ordinary skill in the art will appreciate that different partial connection 505 heights, lengths, and geometries are within the scope of the present disclosure, and as such, the above recommended partial connection properties are merely exemplary. To further describe partial connection properties, different geometric partial connections are detailed below.

Figure 8:
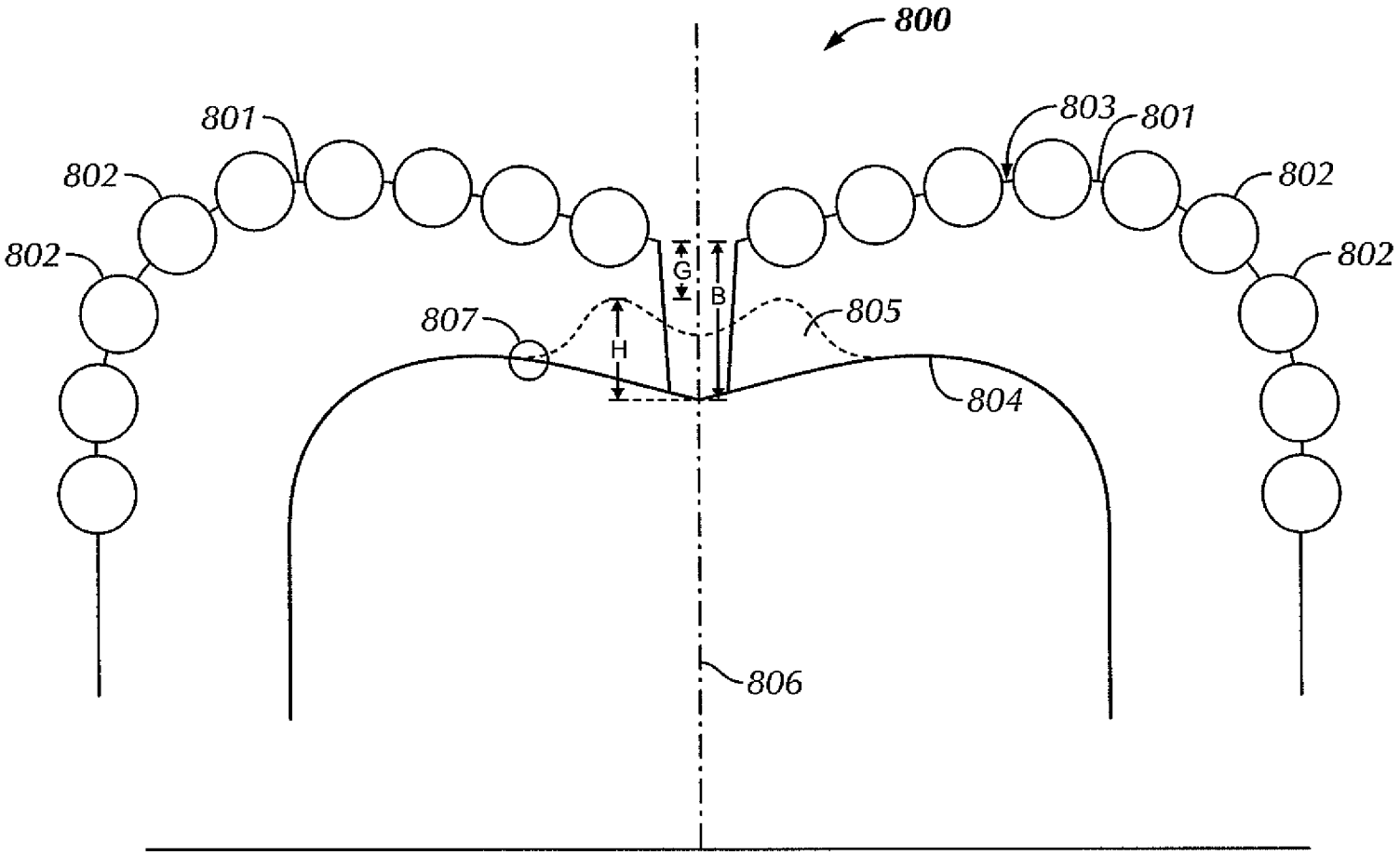
FIG. 8 shows a cross-sectional view of a fixed cutter drill bit according to embodiments of the present disclosure.

Referring to FIG. 8, a cross-sectional view of a fixed cutter drill bit 800 according to embodiments of the present disclosure is shown. In this embodiment, fixed cutter drill bit 800 includes two primary blades 801, a plurality of cutters 802, and a partial connection 805. Partial connection 805 is formed as a raised area between a base portion 804 and a blade height 803, as described above. In this embodiment, partial connection 805 has a complex geometry including a concave center section. More specifically, in this embodiment, partial connection height H is defined as the maximum height of partial connection 805. As illustrated, the maximum height of partial connection 805 is disposed offset from a bit axis 806.

Despite the complex geometry, those of ordinary skill in the art will appreciate that the calculation of a partial connection ratio is the same as described with regard to FIG. 5. Specifically, in this embodiment, the partial connection ratio is expressed as the height of the gap G (i.e., the distance between blade height 803 and the maximum partial connection height H) divided by the blade height B. As described above, in certain embodiments, those of ordinary skill in the art will appreciate that designing a partial connection 805 to include a specific partial connection ratio may optimize bit integrity for a particular drilling operation. Moreover, relief areas, such as the concave portion of the present embodiment, may further distribute stresses or otherwise contribute to bit life. In addition to concave portions, in other embodiments, complex partial connection geometric variations may include channels, recesses, convex potions, rounded portions, or other geometries known to those or ordinary skill in the art.

Figure 9:
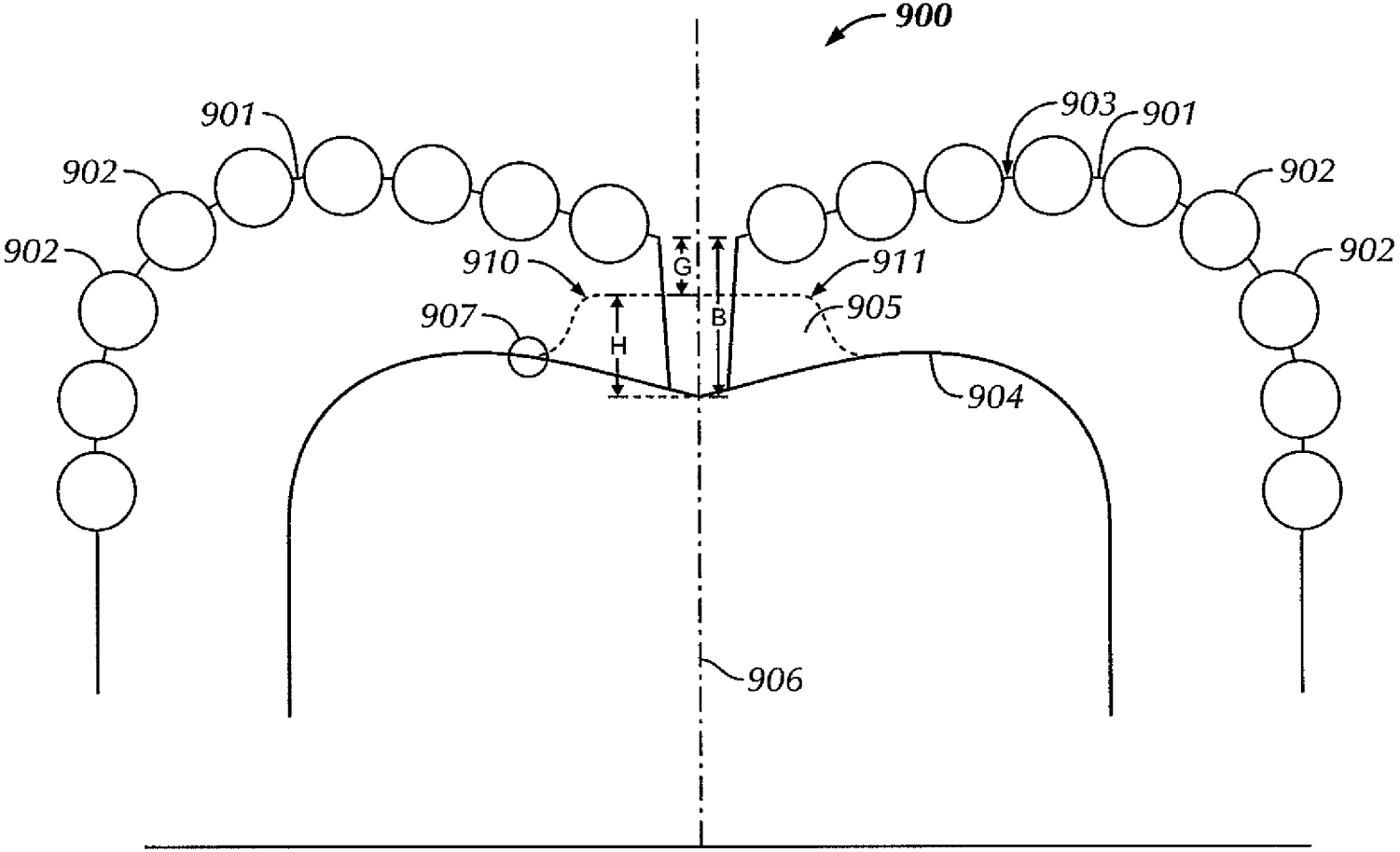
FIG. 9 shows a cross-sectional view of a fixed cutter drill bit according to embodiments of the present disclosure.

Referring to FIG. 9, a cross-sectional view of a fixed cutter drill bit 900 according to embodiments of the present disclosure is shown. In this embodiment, fixed cutter drill bit 900 includes two primary blades 901, a plurality of cutters 902, and a partial connection 905. Partial connection 905 is formed as a raised area between a base portion 904 and a blade height 903, as described above. In this embodiment, a top surface 910 of partial connection 905 is substantially flat.

Those of ordinary skill in the art will appreciate that by making partial connection 905 flat across a relatively larger portion of top surface 910, the thickness, and thus the integrity of bit 900 around a bit center area may be increased. However, those of ordinary skill in the art will further appreciate that even the substantially flat top surface 910 may have rounded corners sections 911 and transitions 907. The rounded corner sections 911 may further decrease stress areas from forming that may increase cracking potential of the bit during drilling. Transitions 907 are also illustrated as being rounded off to further decrease the likelihood of stress locations from forming during drilling, Thus, by decreasing sharp edges, those of ordinary skill in the art will appreciate that partial connection 905 may decrease the formation of stresses during drilling and may thereby increase bit integrity.

Figure 10:
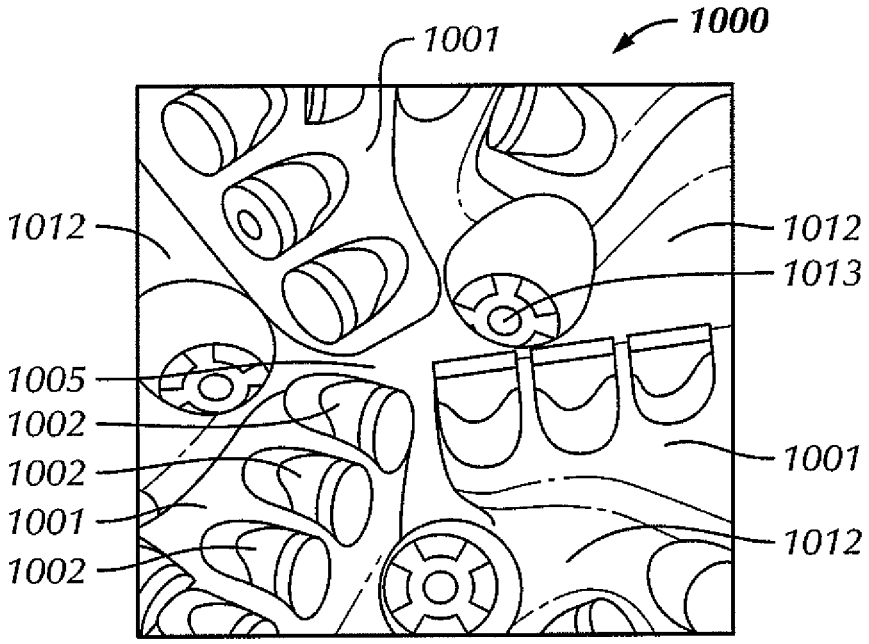
FIG. 10 shows a top view of computer model of a fixed cutter drill bit having secondary blades according to embodiments of the present disclosure.

Referring to FIG. 10, a top view of a computer modeled fixed cutter drill bit 1000 according to embodiments of the present disclosure is shown. In this embodiment, fixed cutter drill bit 1000 includes three primary blades 1001, a plurality of cutters 1002, and a partial connection 1005. Additionally, fixed cutter drill bit 1000 has secondary blades 1012 extending from the bit center, but separated from the bit center by nozzles 1013. Those of ordinary skill in the art will appreciate that in certain embodiments, secondary blades 1012, which may or may not extend from a bit gage to the bit center, may or may not be connect to partial connection 1005. In one aspect of the present disclosure, a transition of partial connection 1005 may overlap with or otherwise form a partial connection between primary blades 1001 and secondary blades 1012.

Figure 11:
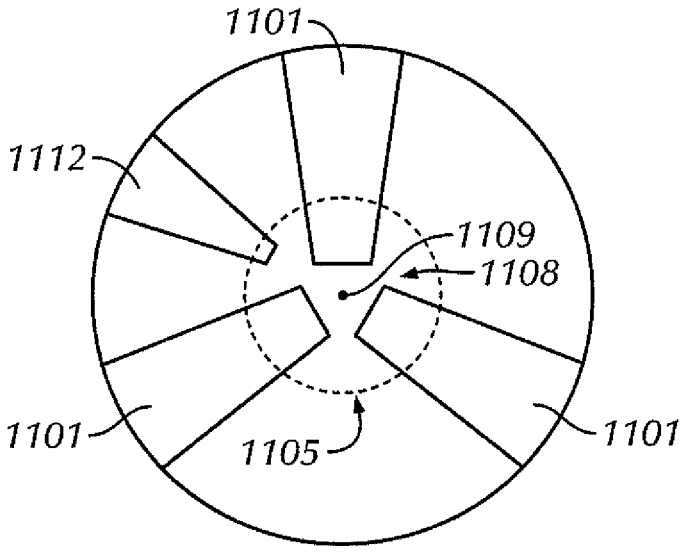
FIG. 11 shows a top view of a fixed cutter drill bit having secondary blades according to embodiments of the present disclosure.

Referring briefly to FIG. 11, a top view of a fixed cutter drill bit 1100 having a secondary blade 1112, according to embodiments of the present disclosure is shown. In this embodiment three primary blades 1101 extend from a bit center area 1108. However, each of primary blades 1101 are oriented around, but a different radial distance from, a geometric bit center 1109. In this embodiment, secondary blade 1112 may be within the partial connection 1105, indicated by the dashed line. As such, partial connection 1105 may extend beyond just the primary blades, and may be included as a design feature around, for example, secondary blades 1112, nozzles (not shown), or other features of fixed cutter drill bits known to those of skill in the art. However, in other embodiments, partial connection 1105 may be designed as an irregular area that specifically excludes design features such as secondary blades 1112 and/or nozzles (not shown). Such an irregular area is specifically illustrated in FIG. 7 above.

When designing fixed cutter drill bits, the methods associated therewith may vary depending on specific components of the drill bit or specific requirements of a drilling operation. As such, the methods for designing fixed cutter drill bits according to embodiments of the present disclosure discussed below are but one method of designing such features.

Figure 12:
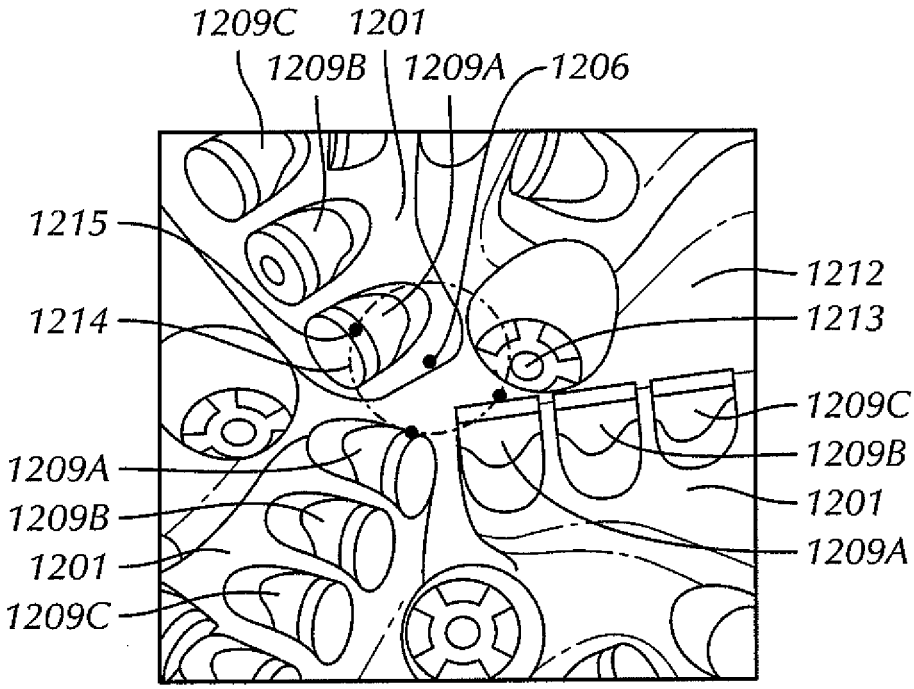
FIG. 12 shows a top view of a computer model of a fixed cutter drill bit during the design process according to embodiments of the present disclosure.
Figure 13:
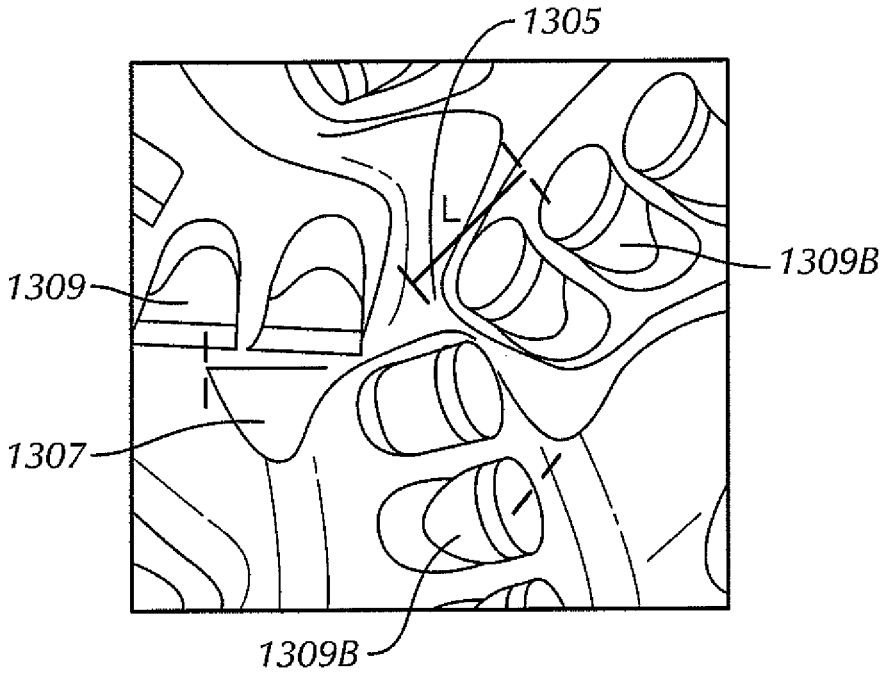
FIG. 13 shows a top view of a computer model of the fixed cutter drill bit during the design process of FIG. 12 according to embodiments of the present disclosure.

Referring to FIGS. 12 and 13 together, top views of computer modeled fixed cutter drill bits according to embodiments of the present disclosure are shown. Generally, when designing fixed cutter drill bits, the drill bit is first modeled using drill bit design software. In this embodiment, the fixed cutter drill bit is modeled to include three primary blades 1201 and a plurality of other design features such as secondary blades 1212 and nozzles 1213. A plurality of cutters 1209 are disposed on the primary blades 1201 such that each blade has at least an innermost cutter 1209A, a second cutter 1209B and a third cutter 1209C. In the initial model, shown in FIG. 12, the fixed cutter drill bit does not include a partial connection, rather, primary blades 1201 are illustrated disconnected.

Initially, when determining the properties of a partial connection, a revolve point of the cutter 1215 of each of the innermost cutters 1209A is determined. Revolve point 1215 refers to a corresponding point on each of innermost cutter 1209A, and may include a geometric center (e.g., 514 of FIG. 5), a tangential edge (e.g., 1215), or any other corresponding points of innermost cutters 1209A. A revolve feature 1214 is then defined with center of the revolve feature being the geometric center 1206 of the area between the center of the cutter face 1215 of each of innermost cutters 1209A. Revolve feature 1214 may then be used to define a length and height of partial connection 1305.

After creating partial connection 1305, a length L of partial connection 1305 may be adjusted to achieve desired bit properties. In FIG. 13, partial connection 1305 is illustrated as being radially extended to correspond with a center of each of secondary cutters 1309B. Those of ordinary skill in the art will appreciate that length L may be adjusted to radially extend to a different distance from the bit center and/or the geometric bit center according to the requirements of a given drill bit. Furthermore, the height and top surface geometry (i.e., a transition geometry) of partial connection 1305 may be further adjusted and/or modified according to the designs discussed above.

After creating partial connection 1305, a transition portion 1307 of partial connection 1305 may be rounded such that the intersection of the partial connection 1305 with the rest of the bit body has a substantially smooth curvature. By rounding out transition 1307, stress points on the drill bit may be further reduced, thereby improving bit integrity. After the design parameters of the bit are adjusted according to a desired design, including adjusting the partial connection 1305 to extend to an appropriate location, the drill bit may be manufactured according to the design. Manufacturing the drill bit may include forming the bit body including the blades and partial connection from, for example, steel or a matrix material, as is known to those of skill in the art.

According to embodiments of the present disclosure, manufacturing fixed cutter drill bits may include forming a bit body having a plurality of primary blades extending radially from a bit center area, wherein the bit center area includes a partial connection between at least two of the plurality of primary blades, as explained above. Forming the bit body may include modeling the bit body on a computer through the use of bit design software. Examples of such models may include two-dimensional or three-dimensional computer models. The models may then be used to form a mold of the bit, and the bit may be cast by infiltration, casting, or other sintering techniques, including layered manufacturing. Infiltration processes that may be used to form a bit body of the present disclosure may begin with the fabrication of a mold. A mass of carbide particles and, optionally, metal binder powder may then be infiltrated with a molten infiltration binder.

Alternatively, casting processes may be used, in which a molten mixture of carbide particles and a binder may be poured into a mold, or melted within a mold, and then cooled to cast the composite body. In still other embodiments, the bit may be formed by machining the bit from, for example, steel. In such an embodiment, the bit may be modeled using bit design software, as described above, and then machined to the design of the model. Those of ordinary skill in the art will appreciate that alternate methods of forming a bit according to the designs disclosed herein are within the scope of the present disclosure, and as such, the methods for manufacturing discussed above are meant to be exemplary, not a limitation on the scope of the disclosure.

Advantageously, embodiments of the present disclosure may increase bit life of fixed cutter drill bits by relieving stresses that occur behind cutters during drilling. Because the partial connection disclosed above may result in less stresses than, for example, fully connected blade bits, fixed cutter bits manufactured according to the methods disclosed herein may exhibit longer drilling life with less repairs.

Furthermore, embodiments disclosed herein may prevent premature cracks from forming across the center of fixed cutter drill bits by increasing the thickness of matrix material or steel at the bit center area. The partial connection may further increase traditionally thin sections of fixed cutter bits located proximate the bit center area. Such thin sections may occur as a result of nozzles or other design features. Because the partial connection disclosed above may increase the thickness of these areas, thin sections traditionally prone to cracking during, for example, the manufacturing process, may be avoided. As such, bit life may be increased.

Also advantageously, the partial connection disclosed above may allow for bit designs that have a smoother curvature, thereby decreasing sharp edges associated with stress points and cracking. The smoother curvature may include, for example, rounded partial connections and smooth transitions between primary blades, primary blades and the bit center area, and primary blades and secondary blades.

Those of ordinary skill in the art will appreciate that by decreasing cracks along the bit center area of fixed cutter bits, less repair operations may be required. Because brazing and repairs processes may result in uneven heating to the bit, thereby generating large temperature gradients, thermal stresses, a known cause of cracking in bit heads and associated with bit repair, may be decreased. By decreasing thermal stresses associated with repair operations, premature cracking and bit failure may further be prevented.

While the present disclosure has been described with respect to a limited number of embodiments, those skilled in the art having benefit of the present disclosure will appreciate that other embodiments may be devised which do not depart form the scope of the disclosure described herein. Accordingly, the scope of the disclosure should be limited only by the claims appended hereto.

What is claimed is:

1. A fixed cutter drill bit comprising:

a bit body having a plurality of primary blades extending radially from a bit center area, the plurality of primary blades including a first primary blade including a cutter, wherein the bit center area comprises a partial connection between at least two of the plurality of primary blades, the partial connection comprising:

a raised area of the bit body at the bit center area extending between at least two of the plurality of primary blades, the raised area having a substantially continuous curved region extending from a base portion of the bit center area to a partial connection height between the base portion and a blade height of any of the primary blades, the raised area extending radially outward so that the raised area radially overlaps at least a portion of the cutter.

2. The fixed cutter drill bit of claim 1, wherein the substantially continuous curved region comprises a smooth portion.

3. The fixed cutter drill bit of claim 1, wherein the partial connection comprises at least one rounded transition.

4. The fixed cutter drill bit of claim 1, wherein the first primary blade includes at least three cutters and a second primary blade includes at least three cutters.

5. The fixed cutter drill bit of claim 4, wherein the partial connection extends between the first and third cutters of the first primary blade and the first and third cutters of the second primary blade.

6. The fixed cutter drill bit of claim 1, wherein the partial connection height of the partial connection is greater than a gap between the partial connection height and the blade height of any of the primary blades.

7. The fixed cutter drill bit of claim 1, wherein a partial connection ratio of a gap between the partial connection height and the blade height of any of the primary blades to the blade height of any of the primary blades of the partial connection is between 0.25 and 0.75.

8. The fixed cutter drill bit of claim 7, wherein the partial connection ratio of the partial connection is about 0.5.

9. The fixed cutter drill bit of claim 1, further comprising: at least one secondary blade formed on the bit body.

10. The fixed cutter drill bit of claim 9, wherein the partial connection connects the at least one secondary blade to at least one of the primary blades.

11. The fixed cutter drill bit of claim 1, wherein the partial connection height is axially between the base portion and the height of the cutter.

12. The fixed cutter drill bit of claim 1, wherein the partial connection height is above the base portion and below a blade height of an innermost portion of the first primary blade.

13. The fixed cutter drill bit of claim 1, wherein the raised area has a variable height.

14. A fixed cutter drill bit comprising:

a bit body having a plurality of primary blades extending radially from a bit center area, the plurality of primary blades including a first primary blade having a cutter, wherein the bit center area comprises a partial connection between at least two of the plurality of primary blades, the partial connection comprising:

a raised area of the bit center area connecting two of the plurality of primary blades, the raised area of the bit center area extending from a base portion of the bit center area to a height above the base portion and below a blade height of each of the at least two of the plurality of primary blades, the partial connection extending radially outward beyond the first cutter.

15. The fixed cutter drill bit of claim 14, wherein a first radial extension from a geometric bit center of a first portion of the partial connection is different than a second radial extension from the geometric bit center of a second portion of the partial connection.

16. The fixed cutter drill bit of claim 14, wherein a gap between the height above the base portion of the partial connection and the blade height of each of the at least two of the plurality of primary blades is greater than a diameter of an innermost cutter disposed on at least one of the at least two of the plurality of primary blades.

17. The fixed cutter drill bit of claim 14, wherein a maximum height of the partial connection is offset from a bit axis.

18. The fixed cutter drill bit of claim 14, wherein the partial connection includes a concave center section.

19. The fixed cutter drill bit of claim 14, wherein the partial connection includes a substantially flat top surface with rounded corner sections.

20. A fixed cutter drill bit comprising:

a bit body having a plurality of primary blades extending radially from a bit center area, the plurality of primary blades including a first primary blade having a cutter, wherein the bit center area comprises a partial connection between at least two of the plurality of primary blades, the partial connection comprising:

a raised area of the bit center area extending from the first primary blade to a second primary blade at a height above a base portion of the bit body and below a blade height of each of the first and second primary blades, the partial connection extending radially outward so that the raised area radially overlaps at least a portion of the cutter.

21. The fixed cutter drill bit of claim 20, wherein the first primary blade is positioned at a different radial distance from a geometric bit center than the second primary blade.

22. The fixed cutter drill bit of claim 20, wherein the partial connection forms an irregular shape.

23. The fixed cutter drill bit of claim 20, wherein the raised area of the partial connection further extends to a nozzle disposed in the bit body.

* * * * *